US005148081A

United States Patent [19]

Neumann et al.

[11] Patent Number: 5,148,081

[45] Date of Patent: Sep. 15, 1992

[54] IN-LINE COLOR PICTURE TUBE

[75] Inventors: Werner Neumann, Denkendorf; Hans Reule, Wendlingen; Werner Wolffram, Kirchheim, all of Fed. Rep. of Germany

[73] Assignee: Nokia Unterhaltungselektronik GmbH, Pforzheim, Fed. Rep. of Germany

[21] Appl. No.: 655,446

[22] PCT Filed: Sep. 4, 1989

[86] PCT. No.: PCT/EP89/01029

§ 371 Date: Feb. 28, 1991

§ 102(e) Date: Feb. 28, 1991

[87] PCT Pub. No.: WO90/03042

PCT Pub. Date: Mar 22, 1990

[30] Foreign Application Priority Data

Sep. 2, 1988 [DE] Fed. Rep. of Germany ..... 3829794

[51] Int. Cl.[5] ..... H01J 29/48

[52] U.S. Cl. ..... 313/414; 313/447

[58] Field of Search ..... 313/414, 447

[56] References Cited

U.S. PATENT DOCUMENTS 4,251,747 2/1981 Burdick ..... 313/414 X 4,629,933 12/1986 Bijma et al. ..... 313/414

*Primary Examiner*—Sandra L. O'Shea

*Attorney, Agent, or Firm*—Ware, Fressola, Van Der Sluys & Adolphson

[57] ABSTRACT

To prevent the formation of a corona (2) in a known in-line color picture tube with an automatic-focusing deflection system and four grids (G1–G4), a rectangular opening is provided on the side of the second grid (G2) facing the first grid (G1). As a result, the luminous spot (1) formed by the electron beam at the center of the screen is converted to a vertical ellipse and the ratio of the axes of the lateral ellipses on the edge of the image is reduced, thus improving the sharpness of the edges. The openings (5) in the first grid (G1) are elongated in the in-line direction, in particular rectangular, the adjacent openings of the second grid (G2) are also rectangular and all the other openings in the other grids (G2, G3, G4) are circular. In this way, the ratio of the axes of the luminous elliptical spot (11) produced by the electron beam at the center of the screen is reduced without adversely affecting the sharpness of the edges.

20 Claims, 3 Drawing Sheets

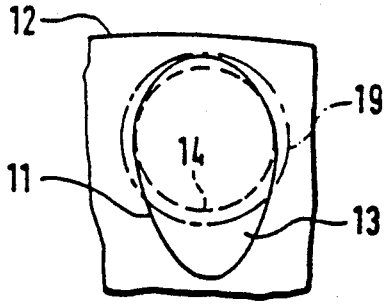
FIG. 2b
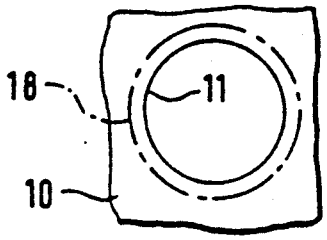
FIG. 2a
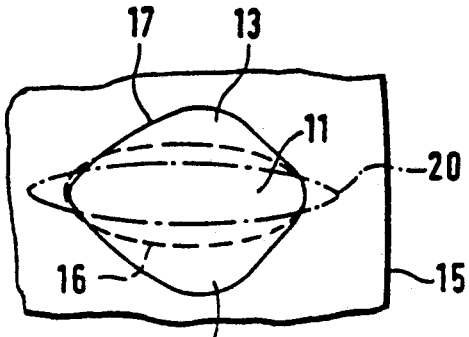
FIG. 2c
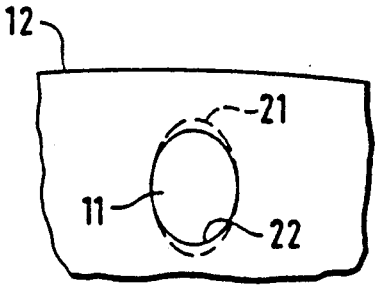
FIG. 6b
FIG. 6a
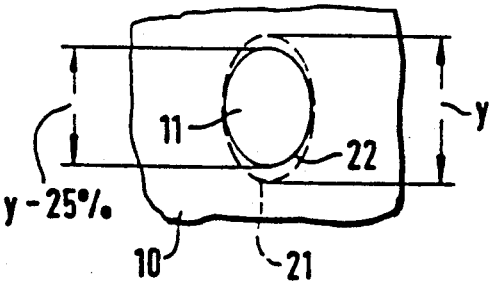
FIG. 6c
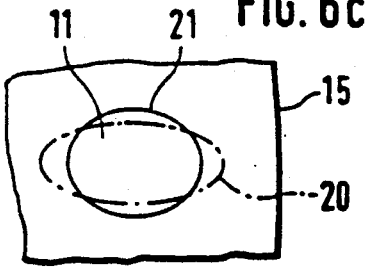
FIG. 7
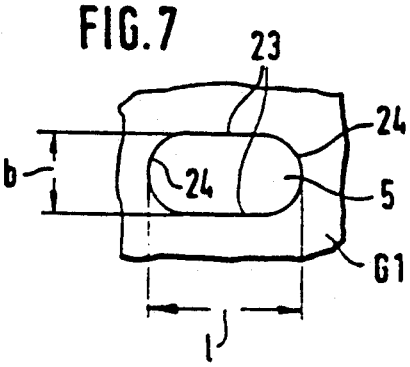
FIG. 5
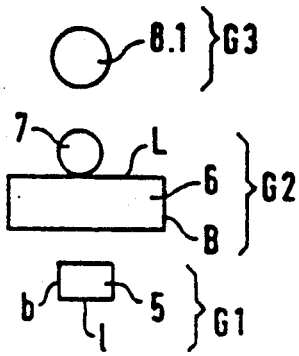

IN-LINE COLOR PICTURE TUBE

DESCRIPTION

The present invention relates to an in-line colour picture tube in accordance with the precharacterizing part of claim 1.

Colour picture tubes provided with a self-converging deflection system suffer from the drawback that the non-homogeneous multiple fields produced by the said system cause distortions of the electron spot produced on the screen, the distortions being such that a circular spot at the centre of the screen, following deflection to the lateral edge of the screen, will be underfocused in the horizontal direction, thereby giving rise to a supine (i.e. horizontal) ellipse with an aureole (or corona) at both the top and the bottom. Though the round shape of the spot remains relatively well preserved after vertical deflections, an aureole is produced as the upper or lower edge of the screen is approached; this aureole always faces inwards, i.e. towards the centre of the screen, and therefore corresponds to overfocusing.

Such spots are produced with electron-beam systems in which the beam apertures are consistently circular. For the reasons just discussed, however, such systems cannot be used.

With a view to avoiding the formation of an aureole, there are known electron-beam systems (cfr. the paper entitled "A High Performance Color CRT Gun With an Asymmetrical Beam Forming Region" by H. Y. Chen and R. H. Hughes, RCA publication ST-5105, presented at the IEEE Chicago Spring Conference on Consumer Electronics, 1980, Chicago, Ill.) in which the apertures of the second grid facing the first grid are rectangular and have a length-to-breadth ratio of about 3:1. Given such apertures in the second grid, one obtains a smaller focusing voltage in the vertical direction than in the horizontal direction and therefore a flatter beam pattern in the area of the upper and lower edge of the screen, this being particularly true as regards the edge rays of the electron beam. In this way one obtains a circular spot in the case of vertical deflection and a spot in the form of an ellipse lying on its side—though with a relatively large axial ratio—in the case of horizontal deflection. The form of the spot at the centre of the screen, however, will in this case be distorted into a standing ellipse with an axial ratio of, say, 1:1.4. Subject to accepting a worsening of the resolution at the centre of the screen, one can thus obtain an improvement in the edge areas.

An electron beam formation system is also known (EP-A 111 872) in which the apertures in the first grid are either of an elongated or a rectangular shape. In this known electron-beam formation system, however, the apertures in the second grid facing the first grid are either circular or elongated in shape, while on the side facing away from the first grid there is provided a rectangular aperture that is common to all three electron beams. This measure is intended to improve the resolution of a colour picture tube of the type described at the beginning hereof by modifying the form of the spot into a horizontal ellipse and preventing the formation of aureoles, above all in the edge areas of the screen. In the known solution this is obtained by means of two asymmetrical lens systems, arranged in sequence and consisting of the grids $\frac{1}{2}$ and $\frac{2}{3}$, and a symmetrical lens system consisting of the grids $\frac{3}{4}$.

An in-line system intended to avoid the formation of vertical aureoles when the spot is deflected horizontally is known from FR-A- 2 437 062. To this end a plate is arranged on the side of the second grid that faces the first grid. This plate is provided with an elongated slit extending in the plane of the electron beam for each of the beams. The apertures in the second grid permitting the passage of the electron beams also terminate in these slits. The effect of these slits arranged in the plane of the beams and their shape is that, as compared with the focusing in the beam plane itself, the electron beams are underfocused in a plane at right angles thereto. This ensures that the spot will be deformed into a standing (vertical) ellipse at the screen centre and a supine (horizontal) ellipse at the lateral edge of the screen. Averaged over the screen as a whole, a better resolution is therefore obtained and this notwithstanding the fact that the resolution at the screen centre is worsened due to this ellipse formation.

The present invention is therefore concerned with further reducing the spot distortions and improving the resolution of the television picture.

This problem is solved by means of the combination of features specified in claim 1. The following effect has been observed when a picture tube is designed in the manner of the present invention:

The spots at the centre of the screen are still characterized by an elliptical distortion, but the vertical diameter of the spot at the centre of the screen is 15 to 25% smaller than in the case of spots produced with the known electron-beam formation systems. Furthermore, the spot dimensions at the edge of the screen do not undergo any substantial modification and, given a proper choice of the focusing voltage, no aureoles will be formed in any part of the screen. Consequently, a considerably improved resolution of the television picture is obtained at the centre of the screen while maintaining good resolution at the edges.

Further advantageous features of the invention are specified in the dependent claims and will be described hereinbelow by reference to an embodiment illustrated by the drawing. For the sake of simplicity, the description will assume a four-grid system, though the invention, of course, is equally applicable to multigrid systems. The figures on the drawing are as follows:

FIG. 1 shows a longitudinal section through an electron beam formation system in accordance with the invention;

FIGS. 2*a* to 2*c* show the forms of the spot at different deflection angles of the electron beam on the screen of a colour picture tube with an electron-beam formation system in which the apertures in the grids are consistently circular and at different focusing voltages;

FIG. 5 shows a schematic representation of the apertures in the three grids following the cathode of the electron-beam formation system of FIG. 1 as shaped in accordance with the invention;

FIGS. 6*a* to 6*c* illustrate the reduction the distortions of the spot at the centre of the screen when the invention is used, and FIG. 7 shows another form that may be given to the aperture in the first grid.

Figure 1:
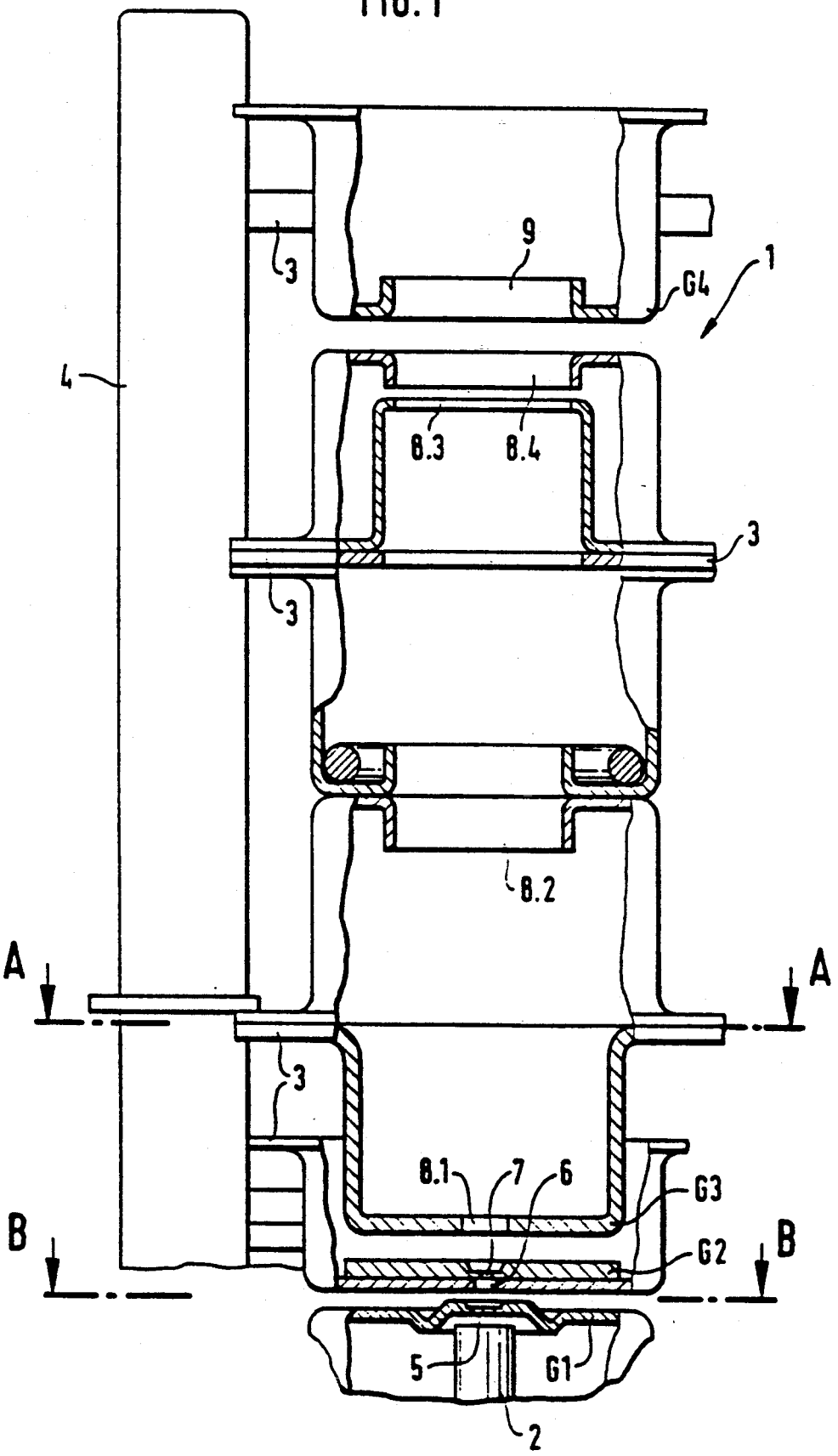

FIG. 1 illustrates an electron-beam formation system 1 consisting of three cathodes 2, which are arranged— one behind the other—in the plane of the figure, the first grid G1, the second grid G2, the third grid G3 and the fourth grid G4, which is connected so as to act as the anode. The individual grids are maintained in position in a known manner by having their lateral edges 3 set into a glass rod 4 while the latter is in a fused state.

Given optimal focusing and apertures 5, 6, 7, 8.1, 8.2, 8.3, 8.4 and 9 in grids G1 to G4 that are of circular shape, such an electron-beam formation system 1 will produce a circular electron spot 11—as illustrated by the unbroken line in FIG. 2*a*—when the electron beams strike the luminophore layer at the screen centre 10. Following a vertical deflection of the electron beam in the direction of the upper edge 12 of the screen, the spot 11 will become slightly deformed into a vertical ellipse and comprise an aureole (or corona) 13 pointing in the direction of the screen centre 10 (FIG. 2*b*). The broken circular line 14 in FIG. 2*b* serves to illustrate the distortions that occur as compared with the perfect circular form.

FIG. 2*c* shows a laterally displaced spot 11 as produced following a horizontal deflection of the electron beam from the screen centre, say, to the right edge 15 of the screen. The actual luminescent spot is indicated by the broken line 16. It has the form of an ellipse lying on its side (=horizontal ellipse). The spot 11 is continued upwards and downwards by the aureoles 13, thus producing an effective form of the spot as illustrated by the unbroken line 17.

As explained at the beginning, these spot forms are based on the use of the self-converging deflection system.

As was likewise mentioned at the beginning, the formation of the aureoles can be eliminated by raising the focusing voltage. But this will increase the size of the spot at the screen centre 10 and at the upper (and lower) edge 12 of the screen, as indicated by the chain-dotted line 18 in FIG. 2*a* and the chain-dotted line 19 in FIG. 2*b*. When deflected in the direction of the lateral edge 15 of the screen, on the other hand, the spot 11 is deformed into a flat ellipse with a large axial ratio lying on its side, this shape being indicated by the chain-dotted line 20 in FIG. 2*c*.

When use is made of a colour picture tube in accordance with the invention, an improvement of the resolution is already obtained by virtue of the fact that the aperture 6 on the side of the second grid G2 (which is designed as a double grid) facing the first grid G1 is given a rectangular shape, with the longer side extending in the in-line direction, and the aperture 7 on the side of the second grid G2 facing the third grid G3 is of a circular shape.

Figure 3:
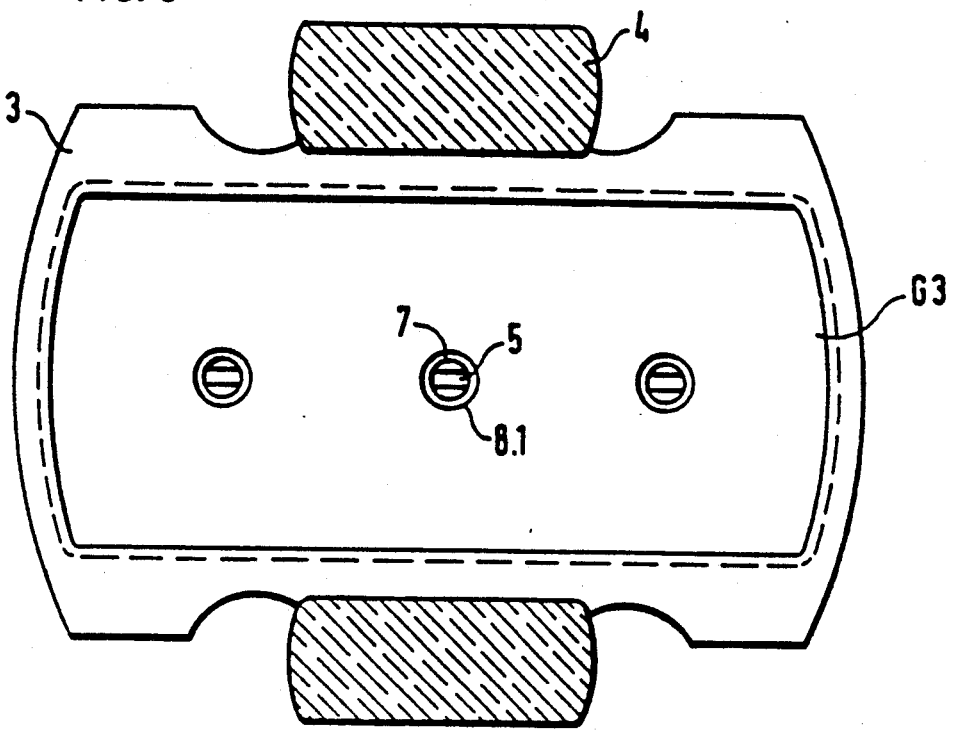
FIG. 3 shows a section view along the line A—A of FIG. 1.
Figure 4:
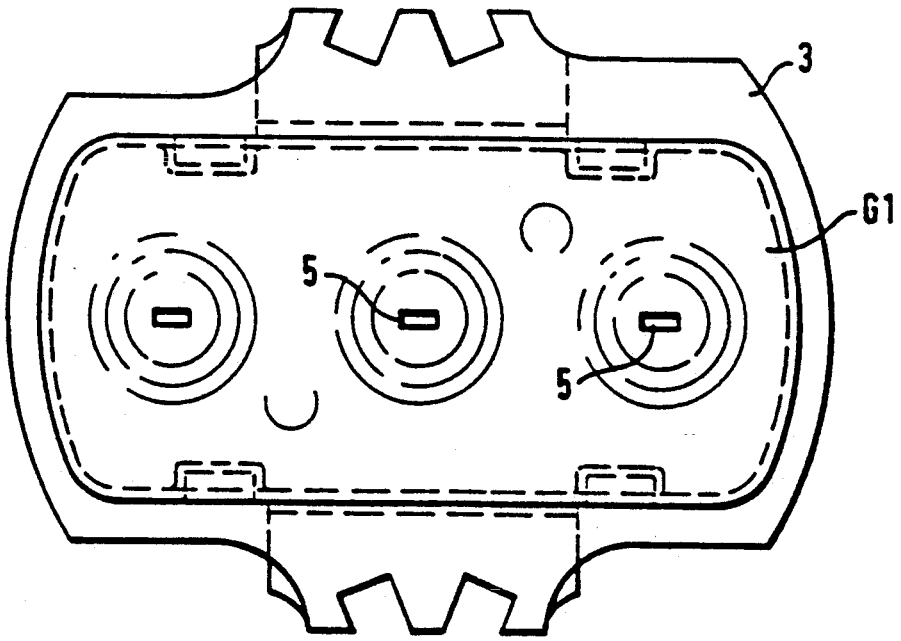
FIG. 4 shows a section view along the line B—B of FIG. 1.

Given such a design of the grid apertures and the use of a focusing voltage at which aureoles 13 no longer occur at the screen centre, the spot 11 at the screen centre will be deformed into a vertical ellipse, i.e. the spot 11 will now be underfocused in the vertical axis. This spot form is indicated by the broken line 21 in FIG. 6*a*. At the same time, however, the spot 11 in the form of a horizontal ellipse that occurs at the lateral edge 15 of the screen following a horizontal deflection is modified in such a way that the previously large axial ratio (line 20) gives way to a small axial ratio. The modified spot 11, which approximates more closely to a circular shape and leads to a better resolution, is shown as the unbroken line 21 in FIG. 6*c*. As averaged over the screen as a whole, these modified spot forms produce better resolution even though the resolution at the screen centre is slightly worsened. According to the invention, the aperture 5 of the first grid G1 is likewise designed in the form of a rectangle. The longer side 1 of this aperture runs in the in-line direction and the ratio between the longer side 1 (length) and the shorter side b (breadth) is in the range between 1:0.8 and 1:0.96. Rather than being rectangular, the aperture may be given some similar elongated shape with a corresponding axial ratio. It is possible and advantageous, for example, to use an oval aperture or, as shown in FIG. 7, an aperture 5 consisting of the long sides 23, which are straight and parallel to each other, joined by semicircular closures at both ends. Furthermore, the ratio between the longer side L (length) and the shorter side B (breadth) of the rectangular aperture 6 of the second grid G2 is chosen so as to be either equal to or greater than 2 (two). The ratio between the side B of the aperture 6 of the second grid G2 and the side b of the aperture 5 of the first grid G1 should lie approximately in the range between 0.95:1 and 1.4:1. This particular design of the apertures 5, 6, 7 and 8.1 of the qrids G1, G2 and G3 is schematically illustrated in FIG. 5, while FIG. 3 illustrates this embodiment as seen in an end elevation along section A—A of FIG. 1. FIG. 4, on the other hand, shows an end elevation of the grid G1 with the rectangular apertures 5 as seen along the section B—B of FIG. 1. It will be appropriate to make the cross section area of the circular aperture 7 of the second grid G2 about 0.85 to 1.15 times as great as the cross section area of the elongated or rectangular aperture 5 of the first grid G1.

When the apertures 5 are designed as just described, a further improvement of the resolution is obtained by virtue of the fact that the elliptical form of the spot at the screen centre 10 is made to approximate more closely to the circular form and that this is not accompanied by any deleterious distortions of the spot at the lateral edge 15 of the screen. This improvement is illustrated in FIGS. 6*a* and 6*b* by means of the unbroken lines 22. The shortening of the major axis of the ellipse 22 drawn as an unbroken line in FIG. 6*b* as compared with the ellipse 21 drawn as a broken line may amount to up to 25% of the major axis of the ellipse drawn as a broken line.

The height of the aperture 5, i.e. the thickness of the first grid G1 in the area of the aperture 5, amounts to about 0.07 to 0.15 mm, and preferably 0.08 to 0.12 mm.

On the side facing away from the grid G1, the aperture 7 of the second grid G2—which is immediately adjacent to the aperture 6—is designed to be of circular shape and it will be appropriate if this aperture is enlarged in the manner of a cone in the direction of the third grid G3. The diameter of this aperture 7 corresponds to about 0.8 to 1.0 times the length of the side B of the aperture 6. The height of the rectangular aperture 6 of the second grid G2 amounts to about 0.2 to 0.4 mm, preferably 0.25 to 0.3 mm, while the height of the adjacent aperture 7 amounts to about 0.4 to 0.8 mm, preferably 0.5 to 0.6 mm. It will be appropriate for the ratio between the height of the rectangular aperture 6 to the height of the circular aperture 7 to be about 0.5:1.

As regards the subsequent grid G3, the apertures 8.1—which are in the immediate vicinity of the apertures 7—are circular, as are the subsequent apertures 8.2, 8.3 and 8.4 of the third grid G3 and the aperture 9 of the fourth grid G4.

The elongated or rectangular aperture 5 in the first grid G1, together with the neighbouring rectangular aperture 6 of the second grid G2, constitutes an asymmetrical beam-forming lens, while the circular apertures 7 and 8.1 of the second and third grids G2 and G3 constitute a symmetrical beam-forming lens. The decisive beam formation therefore takes place in the area of the grids G1/G2.

In one embodiment the dimensions of the aperture 5 in the first grid G1 were 0.55×0.65 mm with a height of 0.08 mm, the dimensions of the rectangular aperture 6 on the side of the second grid G2 facing the first grid G1 amounted to 0.7×2.2 mm and the diameter of the circular aperture 7 on the side of the second grid G2 facing away from the first grid G1 amounted to 0.65 mm. In an electron-beam formation system (electron gun) having the aforesaid dimensions the electron beam produced a spot at the screen centre that, as compared with the spot produced in the conventional manner, was more than 25% smaller in the vertical direction.

We claim:

1. An in-line colour picture tube with a self-converging deflection system and an electron-beam formation system comprising three beam systems arranged side by side, each of the beam systems comprising a cathode, a first, a second and a third grid and at least one further grid, where one of the said grids is designed as an anode and each grid is provided with an aperture for each of the three beam systems and where:

the aperture (5) for each electron beam in the first grid (G1) is designed to be of elongated and especially rectangular shape and the longer side (1) of the said aperture (5) runs in the in-line direction the ratio between the longer and the shorter sides of the apertures (5) of the first grid (G1) amounts to between 1.0:0.8 and 1.0:0.96 the aperture (6) for each electron beam on the side of the second grid (G2) facing the first grid (G1) is designed to be right-angled and the longer side (L) of the said aperture (6) runs in the in-line direction ratio between the sides of the right-angled aperture (6) of the second grid (G2) is equal to or greater than 2 (two)

the shorter side (B) of the aperture (6) of the second grid (G2) is equal to about 1.0 to 1.4 times the shorter side (b) of the aperture (5) of the first grid (G1)

the aperture (7) for each electron beam on the side of the second grid (G2) facing away from the first grid (G1) is designed to be of circular shape the apertures (8.1, 8.2, 8.3, 8.4) for each electron beam in the third grid (G3) and the aperture (9) for each electron beam in the fourth grid (G4) and of any further grids are designed to be of circular shape.

2. A colour picture tube in accordance with claim 1, characterized in that the diameter of the circular aperture (7) of the second grid (G2) amounts to between about 0.8 and 1.0 times the shorter side (B) of the rectangular aperture (6) of the second grid (G2).

3. A colour picture tube in accordance with claim 1 characterized in that the circular aperture (7) of the second grid (G2) is conically enlarged in the direction of the third grid (G3).

4. A colour picture tube in accordance with claim 1 characterized in that the height of the aperture (5) of the first grid (G1) amounts to about 0.07 to 0.15 mm.

5. A colour picture tube in accordance with claim 1 characterized in that the height of the rectangular aperture (6) of the second grid (G2) amounts to about 0.2 to 0.4 mm.

6. A colour picture tube in accordance with claim 1 characterized in that the height of the circular aperture (7) of the second grid (G2) amounts to about 0.4 to 0.8 mm.

7. A colour picture tube in accordance with claim 5 characterized in that the height of the rectangular aperture (6) of the second grid (G2) and the height of the circular aperture (7) of the second grid (G2) are related to each other in the proportion of about 0.5:1.0.

8. A colour picture tube in accordance with claim 1 characterized in that the cross section area of the circular aperture (7) of the second grid (G2) is about 0.85 to 1.15 times as great as the cross section area of the rectangular aperture (5) of the first grid (G1).

9. A colour picture tube in accordance with claim 1 characterized in that the aperture (5) of the first grid (G1) is made roughly rectangular by designing the two longer sides (23) as straight lines running parallel to each other and joining them at each end by semicircular closure (24).

10. A colour picture tube in accordance with claim 2, characterized in that the circular aperture (7) of the second grid (G2) is conically enlarged in the direction of the third grid (G3).

11. A colour picture tube in accordance with claim 2, characterized in that the height of the aperture (5) of the first grid (G1) amounts to about 0.07 to 0.15 mm.

12. A colour picture tube in accordance with claim 2, characterized in that the height of the rectangular aperture (6) of the second grid (G2) amounts to about 0.2 to 0.4 mm.

13. A colour picture tube in accordance with claim 2, characterized in that the height of the circular aperture (7) of the second grid (G2) amounts to about 0.4 to 0.8 mm.

14. A colour picture tube in accordance with claim 6, characterized in that the height of the rectangular aperture (6) of the second grid (G2) and the height of the circular aperture (7) of the second grid (G2) are related to each other in the proportion of about 0.5:1.0.

15. A colour picture tube in accordance with claim 2, characterized in that the cross section area of the circular aperture (7) of the second grid (G2) is about 0.85 to 1.15 times as great as the cross section area of the rectangular aperture (5) of the first grid (G1).

16. A colour picture tube in accordance with claim 2, characterized in that the aperture (5) of the first grid (G1) is made roughly rectangular by designing the two longer sides (23) as straight lines running parallel to each other and joining them at each end by semicircular closures (24).

17. A colour picture tube in accordance with claim 3, characterized in that the circular aperture (7) of the second grid (G2) is conically enlarged in the direction of the third grid (G3).

18. A colour picture tube in accordance with claim 3, characterized in that the height of the rectangular aperture (6) of the second grid (G2) amounts to about 0.2 to 0.4 mm.

19. A colour picture tube in accordance with claim 3, characterized in that the height of the circular aperture (7) of the second grid (G2) amounts to about 0.4 to 0.8 mm.

20. A colour picture tube in accordance with claim 3, characterized in that the cross section area of the circular aperture (7) of the second grid (G2) is about 0.85 to 1.15 times as great as the gross section area of the rectangular aperture (5) of the first grid (G1).

* * * * *